United States Patent [19]

Carter et al.

[11] 4,000,388

[45] Dec. 28, 1976

[54] BREAKER SWITCH FOR AUTO BATTERY

[76] Inventors: E. L. Carter; George Spector, both of 3615 Woolworth Bldg., Broadway, New York, N.Y. 10007

[22] Filed: Dec. 23, 1974

[21] Appl. No.: 535,449

[52] U.S. Cl. ..... 200/162; 200/61.45 R; 307/10 BP

[51] Int. Cl.[2] ..... H01H 21/54

[58] Field of Search ..... 200/162, 15, 161, 61.45–61.53, 200/275, 291; 307/10 AT, 10 BP, 121; 339/74 R, 253 R, 258 R, 258 P

[56] References Cited

UNITED STATES PATENTS

| | | | |
|---|---|---|---|
| 2,104,689 | 1/1938 | Barker et al. | 200/162 |
| 2,559,423 | 7/1951 | Gregory | 200/162 |
| 2,816,188 | 12/1957 | Stout | 200/61.45 R |
| 2,894,240 | 7/1959 | Mautner | 339/258 |

*Primary Examiner*—Robert K. Schaefer
*Assistant Examiner*—Morris Ginsburg

[57] ABSTRACT

An accessory mountable within an automotive vehicle for preventing the vehicle to catch on fire in case any wiring is suspected to become shorted; the accessory consisting of a block mountable anywhere in the engine compartment, the block supporting terminals connected to the battery and to the ground, and one terminal having a pivotable throw arm contacting the other terminal; the battery entire electric output being passed through the accessory so that if the throw arm is pivoted away breaking the contact between the accessory terminals, the electric system of the vehicle is off.

3 Claims, 6 Drawing Figures

BREAKER SWITCH FOR AUTO BATTERY

This invention relates to automotive vehicle safety devices.

A principle object of the present invention is to provide a breaker switch for an auto battery that serves as a main switch to shut off all the electric circuits in the vehicle in case of a danger of the car catching on fire, such as when a person is suspicious of a shorted wiring.

Another object is to provide a breaker switch that would fire protect a person trapped in a car after an accident, the switch being made to be controlled by the trapped person so he can help himself in case no one else is around to help him.

Still another object is to provide a breaker switch that can be sold as a kit so it could be mounted into any existing car, as well as incorporated into new models during their manufacture.

Other objects are to provide a breaker switch for an auto battery which is simple in design, inexpensive to manufacture, rugged in construction, easy to use and efficient in operation.

These and other objects will be readily evident upon a study of the following specification and the accompanying drawing wherein.

Figure 1:
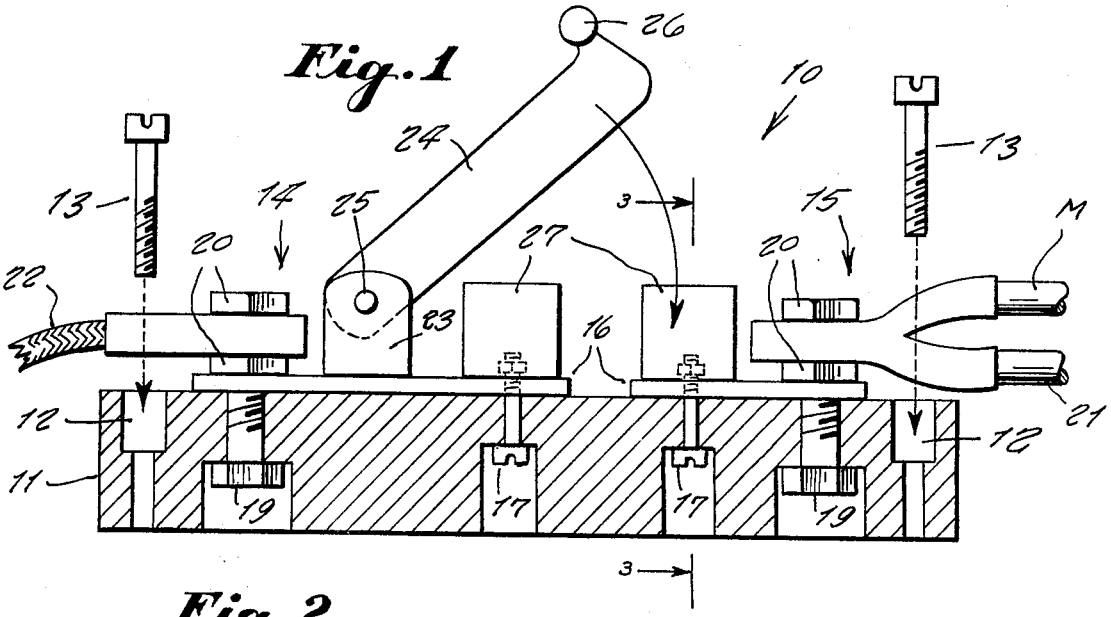
FIG. 1 is a side cross sectional view of a storage battery breaker switch assembly comprising one design of the invention.
Figure 2:
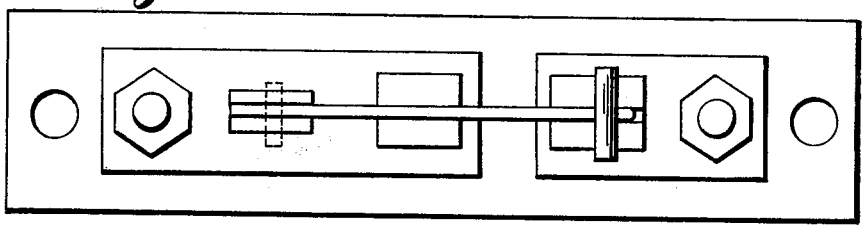
FIG. 2 is a top view thereof.
Figure 3:
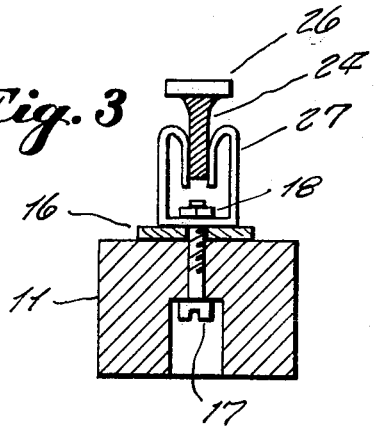
FIG. 3 is a cross section on line 3—3 of FIG. 1 showing the copper plate clip.

Referring now to the drawing in detail, and more particularly to FIGS. 1 to 3 thereof at this time, the reference numeral 10 represents a breaker switch 10 according to the present invention which consists of a base block 11 made of insulation material, having openings 12 at opposite ends to receive mounting screws 13 so the block can be mounted to a fire wall of an engine compartment or other suitable place.

A positive terminal 14 and a negative terminal 15 are mounted spaced apart upon the block, and each consists of a flat copper plate 16 secured thereupon by a small bolt 17 and nut 18 at one end. An opposite end of each plate 16 is secured to the block by a large bolt 19 fitted with a pair of nuts 20 between which a ground cable 21 is secured to the negative terminal and a battery cable 22 is secured to the positive terminal. Additonally a cable M is connected between the negative terminal and the vehicle motor.

The positive terminal 14 additionally includes a pair of flat posts 23 mounted or formed on the plate 16 and between which one end of a copper throw lever or arm 24 is pivotable about a pivot pin 25. A cross handle 26 preferably of insulation material is secured on an outer end of arm 24. A leaf spring jaw contact 27 of flexible copper is also mounted on each plate 16. The contacts 27 are positioned so that when the arm is pivoted down it is clamped by the contacts 27 on both negative and positive terminals so that an electric circuit is established between the terminal.

However, in operative use, when all electric systems of the vehicle are wished to be disconnected, the arm is simply pivoted up, as shown in FIG. 1. It is to be understood that in order that the breaker switch serves as a main switch of the vehicle for disconnecting all electric systems, that the positive terminal of the battery is connected only to the terminal 14 of the unit.

A pull rod or cable, not shown, may be connected to cross handle 26 and leads to the dashboard so a person trapped inside a car can open the circuit in case no one else is around, and the car is in danger of fire after an accident.

Figure 4:
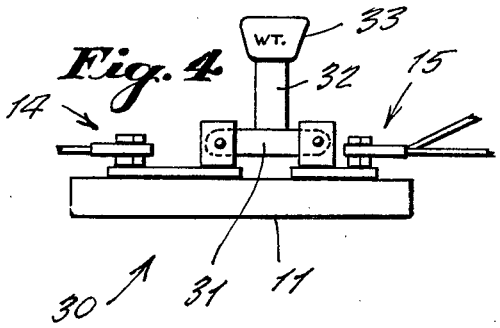
FIG. 4 is a side view of a battery showing a modified design of the invention in which the battery automatically disconnects in case of a collision impact either from a front or a rear.
Figure 5:
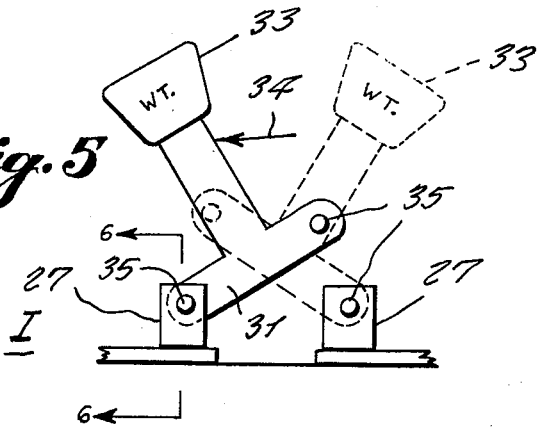
FIG. 5 is an enlarged detail thereof showing how a collision impact effects a weight integral with a bridging copper plate, to swing up and break the circuit.
Figure 6:
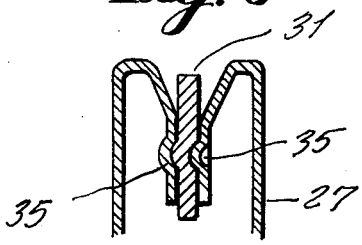
FIG. 6 is a cross section on line 6—6, of FIG. 5.

In FIGS. 4 to 6, a modified design of breaker switch 30 incorporates the features of the above described breaker switch 10 except that instead of the throw arm 24 pivoted on 25 of the posts 23, the modified design replaces these by an entirely separate copper bar 31 which at each end is frictionally held in the contacts 27 of the two terminals. The bar is integral with a right angle arm 32 on the end of which there is a heavy weight 33.

In use this form of the invention necessitates that the base is mounted in a horizontal position and preferably with the terminals being along a longitudinal axis of the vehicle so to accomplish its intended use. In this form of the invention the circuit automatically breaks by an impact of a collision either at a front or rear end of the vehicle; the momentum force of the weight pulling one end of bar 31 out of one of the contacts 27 as shown in FIG. 5 wherein, for example, an impact at position I suddenly arrests leftward travel of the vehicle, but the impact force does not halt the momentum of the weight traveling in direction 34 so the weight lifts the bar, as shown by the solid lines. Dimples 35 on the bar and contacts increase frictional hold in normal vehicle use.

While various changes may be made in the detail construction, it is understood that such changes will be within the spirit and scope of the present invention, as is defined by the appended claims.

We claim:

1. In a breaker switch mountable on an automative vehicle, the combination of a base block of insulation meterial, mounting openings for said block at each end of said block, a pair of spaced apart terminals mounted upon said block, each terminal consisting of a flat copper plate secured to said block at one end by a small bolt and at its other end by a large bolt, said large bolt being fitted with a pair of nuts, each said plate having an upstanding leaf spring jaw contact adapted to retain removably a flat copper bar, one said terminal having a cable from a battery of said vehicle connected thereto between said nuts, so to comprise a positive terminal, and the other said terminal has a ground cable to a frame of said vehicle and a ground cable to a motor of said vehicle secured between said nuts so to comprise a negative terminal and said flat copper bar removably mounted in said leaf spring jaw contacts to close and open a circuit between said terminals, wherein all of said openings, bolts and contacts are aligned on the block center line.

2. The combination as set forth in claim 1 wherein said copper bar is pivotably mounted in a contact at one end on a pair of flat posts upstanding on said copper plate of said positive terminal, said bar end being between said posts, including an insulated throw arm spaced from said pivotable end.

3. The combination as set forth in claim 1 wherein said copper bar is removably held at each end in said spring jaw contacts, including a right angle arm integral with a center of said copper bar having a weight on its outer end, wherein said spring jaw contacts include greater means for retaining the bar ends against downward pushing forces than against upward pulling forces.

* * * * *